United States Patent [19]

Krakauer

[11] 4,331,361

[45] May 25, 1982

[54] POSTURE CHAIR BACK

[75] Inventor: Daniel Krakauer, Great Neck, N.Y.

[73] Assignee: Kay Springs, Incorporated, Syosset, N.Y.

[21] Appl. No.: 152,509

[22] Filed: May 22, 1980

[51] Int. Cl.[3] ..... A47C 7/02

[52] U.S. Cl. ..... 297/460

[58] Field of Search ..... 297/460, 284, DIG. 2

[56] References Cited

U.S. PATENT DOCUMENTS

| | | | |
|---|---|---|---|
| 1,917,264 | 7/1933 | Kellogg | 297/460 |
| 2,855,986 | 10/1958 | Engelen, Sr. | 297/460 |
| 3,145,054 | 8/1964 | Sopko, Jr. | 297/460 |
| 3,361,471 | 2/1968 | Radford | 297/460 |
| 3,545,808 | 12/1970 | Gescheidle | 297/460 |
| 3,606,464 | 9/1971 | Arbuthnot | 297/460 |
| 3,990,742 | 11/1976 | Glass et al. | 297/284 |
| 4,189,182 | 2/1980 | Rhoe | 297/460 |

*Primary Examiner*—Doris L. Troutman

[57] ABSTRACT

A chair having a seat and a seat back with said seat back having spaced-apart upright members to accommodate the back of a chair occupant in which spaced springy support means are provided in selected regions against which the chair occupant contacts to urge the rib cage and chest outwardly and urge the lumbar vertebral arch rearward, to induce minimal stress in the seated spine by reducing its curvatures.

10 Claims, 4 Drawing Figures

POSTURE CHAIR BACK

BACKGROUND AND OBJECTIVES OF THE PRESENT INVENTION

There is a constant stream of new chair designs for office, home, waiting rooms, and the like, which purport to be especially designed for optimum posture of the chair occupant. Typically, the back portion of these chairs is designed to match the curves of the human trunk.

The human trunk has three distinct areas with different curvatures. The lowest, the pelvic girdle itself, is for all practical purposes a monolithic structure although embryologically it is made up of several fused bones. Firmly set into the pelvis, tilted forward at an angle of approximately 30°, is the sacral portion of the spine, which can be visibly differentiated on the skeleton but is actually so firmly entrenched that it is usually considered part of the pelvis.

The next higher spinal area of the trunk consists of five lumbar vertebrae between the pelvis and the ribs. They curve forwardly from the highest sacral vertebra at the 30° angle noted above, and then curve backwards to connect with the thoracic, rib-bearing vertebrae. The lumbar vertebral arch is therefore forwardly convex, a status termed "lordosis." From the rear, the lumbar arch is discernible as the hollow of the back. A certain degree of loadosis is normal, but excessive loadosis, due to faulty posture, is well known to be the most common cause of low back pain and sciatica for reasons to be noted.

The third and highest trunk area consists of the thoracic vertebrae, which are part of the rib cage. They arch in the reverse direction from the lumbar vertebrae, being convex dorsally. Dorsad curvature is known as "kyphosis." Some degree of kyphosis in the thoracic spine is completely normal, but excessive kyphosis, characterized by a drooping chest and rounded shoulders, can produce back pain in various areas of the back, either directly or because it influences lumbar and cervical curvatures.

Above the trunk, the cervical vertebrae of the neck region support the head. These bones, too, are normally lordotic, but may also produce local or referred pain if excessively lordotic.

Spinal flexibility is possible because of the spinal disks, cartilaginous pads between each vertebra. They are quite thick and, in fact, take about 25% of the length of the spine. The vertebrae and disks are chiefly unitized by two strap-like ligaments which extend the heights of the spine front and back, and encase the vertebrae like a flexible support stocking. They are known as the Anterior and Posterior Longitudinal Ligaments. Both long ligaments are endowed with sensitive nerves, and they are the principal cause of back pain when they are overstretched by excessive lordosis or kyphosis.

Another frequent cause of pain is contact or pinching of the nerves emerging from the spinal cord, due to excessive spinal curvatures at any point. This produces referred pain in the parts of the body served by the nerve in question. Sciatica is the most common example.

Medical research and experience in relation to back injuries has proven that the minimal stress condition on the spine, the disks and the long ligaments occurs when the spine is straight. In fact, the universal first treatment for spinal injuries is to place the patient flat on his back in a firm bed and even to attach a harness to the hips which rotates the hip forwardly upwards, reducing the angle of the lumbo-sacral joint, and allowing further flattening of the lumbar arch. See Cailliet *Low Back Pain Syndrome,* F. A. Davis Co., Philadelphia, 1968.

Healthful seating should be designed to encourage low stress posture in the spine, by reducing the various curvatures, and it is therefore an object of this invention to achieve this objective particularly in the utilization of office chairs and other types of work-oriented seating. The invention is particularly directed to the backs of posture-oriented chairs, and discloses a structure that is designed to encourage and urge correct seating posture.

Surprisingly, seat backs have not been properly designed for this purpose. There are many so-called "posture" chairs, but they are characterized by two common fallacies. The most prevalent one is the theory that the lumbar curve has to be supported by the back of the chair. In actuality, the lumbar curve is self-suporting dorsad, which can be demonstrated readily as follows: three stools may be place so that a person lying on them on his back is supported under the shoulders, under the buttocks, and under the heels. It will be readily observed, both subjectively and objectively, that the spinal column supports the body between the first two stools without any assistance or muscular effort.

Since the lumbar curve is self-supporting dorsad, it follows that the best approach to low stress in the lumbar area is to allow the lumbar spine to relax dorsad in the seated position into its own natural minimal curve. This is far better than to support the lumbar spine, which will not result in minimal stress.

The second common fallacy is that the upper back, which is normally somewhat convex dorsad, should be encouraged to remain convex by a matching curvature of the seat back. This, in fact, discourages the proper chest expansion and spinal straightness that should occur so that the upper spine and head balance in an easy, comfortable and healthy way on the middle and lower spine, and stresses are minimized in the thoracic and cervical spine.

Therefore, it is a further objective of the present invention to provide a seat back which corrects the ill-fitting and unhealthy posture effects of the types of backs of chairs presently known and described above.

In the present design, the lower portion of the seat back may be open or recessed so that no support is provided to the lower lumbar spine. Instead, the lumbar spine is allowed to take its own minimal, low stress, curve. This portion of the back design is, therefore, either open or approximately vertical so that it does not contact the relaxed lower spine. A padded area is provided the lower limit of which ranges from six inches to eight inches above the seat near the junction of the upper lumbar spinal bones and lower thoracic spinal bones where the spinal support actually begins.

Above this point or region, a convex, preferably springy, support in the horizontal plane is provided for the thoracic spine and the shoulder blades. A convex support helps or urges the chest to expand, reduces kyphosis, encourages deeper breathing, and tends to align the upper spine so that the head is balanced evenly over it with minimal muscular stress.

Since the trunk of the occupant of the present chair design will not rest heavily against the back, the spring or padding may be modest, and there are many ways to spring or pad the structure.

The preferred structure utilizes a single size of sinuous springs for simplicity in manufacture. In the middle part of the seat back, the sinuous springs are installed flat or in reverse to present a flat or concave curvature (in the horizontal plane) behind the thoraco-lumbar joint. In the thoracic area, the arced sinuous springs are installed in the standard manner by having a convex forward portion providing full use of the arched potential to provide a luxurious but convex support behind the ribs and shoulder blades.

This invention will be more fully comprehended by those skilled in the seating art from the more detailed description that follows including the description of the drawing, and the claims in which modifications and variations as well as equivalents are contemplated.

BRIEF DESCRIPTION OF DRAWING OF PREFERRED EMBODIMENT

DETAILED DESCRIPTION OF PREFERRED EMBODIMENT

Figure 1:
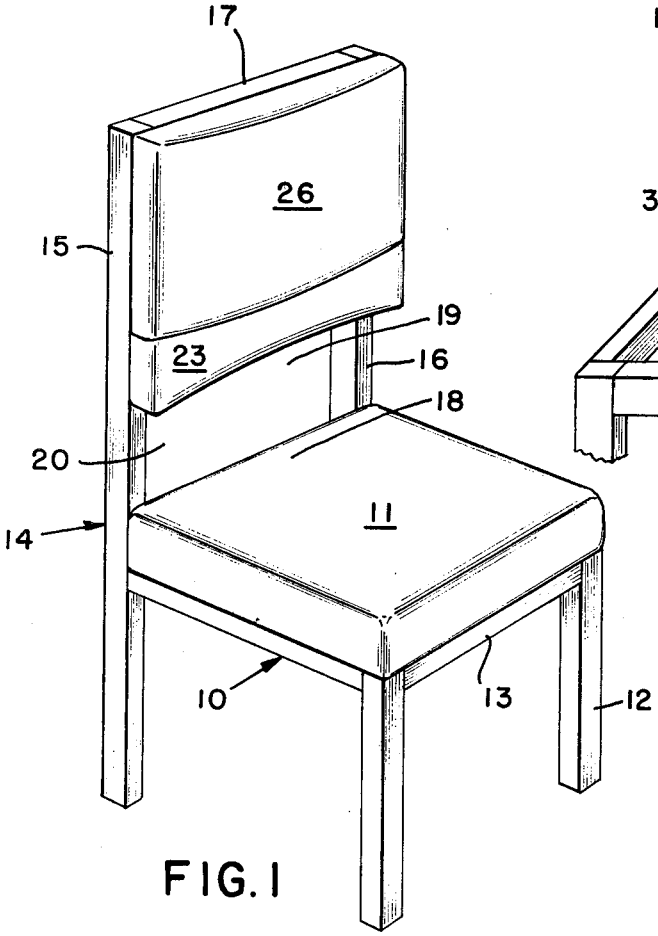
FIG. 1 is a perspective view of a posture chair back embodying the invention.
Figure 2:
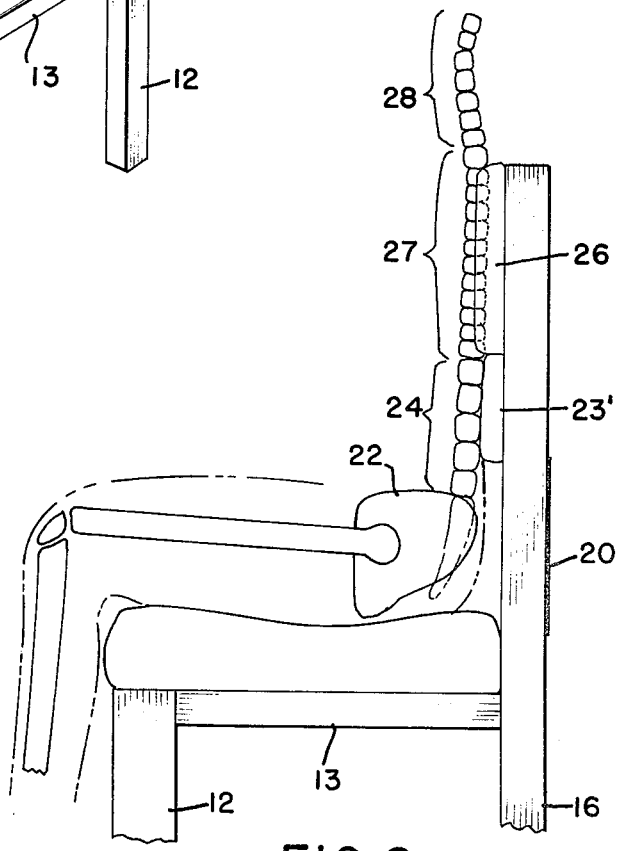
FIG. 2 is a partial side elevational view of a posture chair back embodying the invention on which there is positioned a portion of a skeleton for purposes of illustration only with portions omitted and illustrating the desired minimal lordosis and kyphosis.

Referring to the drawing and particularly to FIGS. 1 and 2, there is illustrated a chair 10, which may be classified broadly as a work chair, in which the seat 11 may be of padded foam construction with an appropriate fabric or vinyl covering that is supported a suitable distance above a floor level by means of the legs 12 and the frame 13. However, it will be readily appreciated that a suitable seat may be supported above the floor level by means other than conventional chair legs 12.

The chair back 14, for the purpose of describing this invention, is preferably a vertical frame construction having laterally spacedapart support members 15 and 16 to accommodate the back of a seat occupant with a top rail 17 bridging between the members 15 and 16. However, it should be apparent that other constructions may be utilized that will be capable of supporting the back of a seat occupant in the manner heretofore described.

Directly above the cushion edge 18 is an opening 19 in the lower portion of the seat back so that no support is provided for the seat occupant's lower lumbar spine. A suitable fabric panel 20 may be affixed to the rear of the opening 19 or a relatively flat cushion insert may be provided for ornamental purposes primarily since it is desirable that the lower portion of the seat back will permit the lumbar spine to take its own minimal, low stress curvature without contacting the relaxed lower spine.

This feature is illustrated in FIG. 2. Also shown is the collateral effect on the pelvic girdle 22 which tends to "slouch," so that the sacral bones become positioned approximately vertically instead of tilting forward. Consequently, the lumbo-sacral joint, which is the point of attachment to the lowest lumbar spinal bone, becomes approximately horizontal, further urging the lumbar arch to flatness.

Directly above the opening 19 in the chair back is a first back supporting means 23 that is supported to project forwardly of the seat back frame 14 to engage the back of the occupant within the region of the upper lumbar vertebrae and the lowest thoracic vertebrae of the seat occupant. Preferably, the first back supporting means 23 may be a relatively firm cushion or formed of flat or reverse-arced sinuous springs to present a substantially flat or slightly concave configuration to maintain the lumbar vertebrae in vertical alignment as shown in FIG. 2. The embodiment that incorporates the reverse-arced sinuous springs will be described hereafter. The first back supporting means 23 may incorporate a urethane foam pad of suitable firmness to achieve the vertical positioning of the lumbar vertebrae 24.

Directly above the first back supporting means 23 is a second back supporting means 26 which extends vertically above the first back supporting means 23 to provide support for the thoracic spine 27 and the shoulder blades of the seat occupant. It is desirable that the second back supporting means 26 have a convex configuration that extends forwardly of the first back supporting means 23 to urge the chest of the chair occupant to expand, encourage deeper breathing, and will tend to align the upper spine so that the head is balanced easily over it with reduced curvature and minimal muscular and skeletal stress in both the thoracic and cervical spine region 27 and 28. The skeletal configuration of the full spine illustrated in FIG. 2 illustrates the desired posture with reduced lordosis and kyphosis in the different spinal areas sought to be induced by the present back supporting means for the chair illustrated.

It is obvious that the chair occupant will have to be positioned so that the pelvis also will be essentially as shown in FIG. 2. The correct position of the chair occupant may be described as slouched at the lumbar spine and forwardly erect at the thoracic and cervical spine.

It is to be noted particularly that the second back supporting means 26 is depressed because it is sprung but that it presses forwardly, whereas the first back supporting means 23 is quite firm. The thoracic spine of the chair occupant is thus urged to straighten. The padded area in the first back supporting means 23 may be provided in the range of from six inches to eight inches above the seat near the junction of the upper lumbar spinal bones and the lower thoracic spinal bones where the spinal support actually begins. The ultimate objective is for the full spine to be influenced to take minimal, low stress curves in the seated position of the occupant.

In those constructions in which urethane foam is employed, various types of fabric or vinyl coverings may be used for each of the back supporting means.

Figure 3:
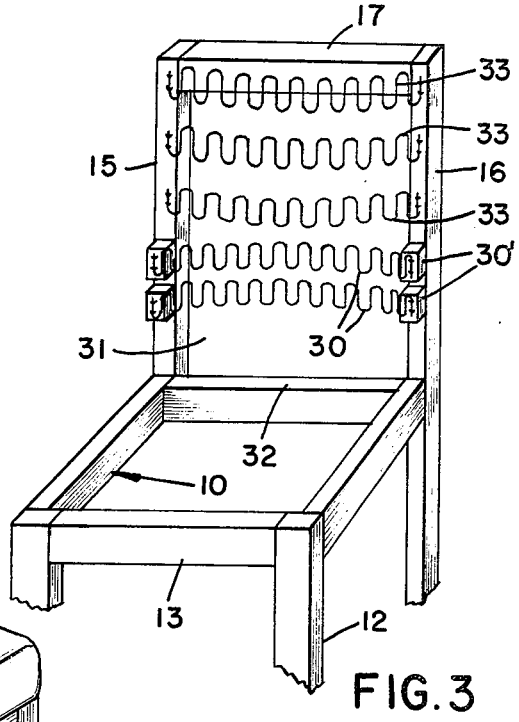
FIG. 3 is a partial perspective view of a posture chair back with a back portion having arced sinuous springs.
Figure 4:
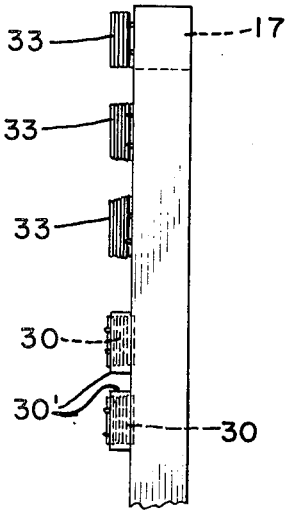
FIG. 4 is a partial enlarged right end view of the back portion of FIG. 3.

An alternative embodiment is illustrated in FIGS. 3 and 4 which may be combined with the cushion construction shown in FIGS. 1 and 2 whereby one or more arced sinuous springs 30 are suitably secured to the seat back members 15 and 16 with the springs 30 being spaced vertically above the opening 31 above the chair seat frame 32. The sinuous springs 30 each of which is preferably mounted on 1 inch pads 30' which are secured to the back members 15 and 16, form the first back supporting means and the springs 30 will preferably be arched concavely or may be substantially planar depending upon the padding or cushioning to be mounted over the spring members 30. Preferably, the spring members 30 will have a slightly concave arch to match the curvature in the horizontal plane of the back at that level for comfort. However, in the thoracic spine and shoulder blade area 27 in which the arced sinuous springs 33 extend transversely and are secured to the vertical back members 15 and 16 with each of the sinuous springs 33 being arched convexly forward, the springing must be resilient enough to partially yield to the thoracic kyphosis. The springs 33 may assume a flat as opposed to an arched convex configuration provided they depress under the load or the padding is suitably contoured.

In those applications where light padding only is employed, it is preferable to utilize arched sinuous springs 33 that extend convexly out of the plane of the chair back with the springs 30 extending slightly concavely inwardly in the chair back.

It will be readily apparent that many modifications and variations may be made with respect to the size and number o sinuous springs or other springy cushioning materials that may be employed to achieve the desired contour once the concept of this invention is recognized and such modifications are contemplated within the scope of the appended claims.

I claim:

1. A chair having a seat positioned a suitable seating distance above floor level and a seat back associated with said seat to accommodate the back of a chair occupant, said seat back having a first back supporting means spaced vertically from said seat having a substantially horizontal thoraco-lumbar-joint-engaging projecting surface, and a second back supporting means spaced vertically above said first back-supporting means and protruding convexly forwardly in the horizontal plane above said seat beyond said thoraco-lumbar-joint-engaging projecting surface in its uncompressed state, to urge the thoracic spine forwardly whereby to bring the full spine in a seated position into minimal curvature and induce low stress posture in the spine of the chair occupant.

2. A chair as claimed in claim 1, said seat back having an opening between said seat and said first back supporting means.

3. A chair as claimed in claim 1, said seat back having an opening between said seat and said first back supporting means, and a covering means over said opening opposite from said first back supporting means and at a lower level therefrom.

4. A chair as claimed in claim 1, said first back supporting means having a relatively firm surface above said seat, and said second back supporting means having a substantially springy support.

5. A chair as claimed in claim 1, said first back support means having a substantially flat relatively firm support, and said second back supporting means having a springy convex support.

6. A chair as claimed in claim 1, said first back supporting means having an arced sinuous spring, and said second back supporting means having an arced sinuous spring.

7. A chair as claimed in claim 1, said first back supporting means having an arced sinuous spring projecting concavely relative to said seat back, and said second back supporting means having an arced sinuous spring projecting convexly relative to said seat back.

8. A chair as claimed in claim 7, said first and second back supporting means having covering said springs.

9. A chair as claimed in claim 1, said seat having a nonsupportive area between said seat and said first back supporting means, said first and second back supporting means having arced sinuous springs with the sinuous springs in said first back supporting means being concave relative to said seat back, and said second back supporting means being concave relative to said seat back.

10. A chair as claimed in claim 1, said first back supporting means being concave forwardly relative to said seat back and including a plurality of arced sinuous springs, and said second back supporting means projecting forwardly relative to said seat back a greater distance than said first back supporting means and having a plurality of arced sinuous springs projecting convexly over said seat and extending forward of said seat back a distance greater than said first back supporting means, and being sufficiently resilient to depress under load backwardly relative to said first means.

* * * * *